US008888245B2

(12) United States Patent
Kurosu et al.

(10) Patent No.: US 8,888,245 B2
(45) Date of Patent: Nov. 18, 2014

(54) LIQUID EJECTION HEAD HAVING PROTECTED ORIFICE PLATE AND METHOD FOR MANUFACTURING LIQUID EJECTION HEAD

(71) Applicant: Canon Kabushiki Kaisha, Tokyo (JP)

(72) Inventors: Toshiaki Kurosu, Oita (JP); Kazumasa Matsushita, Kawasaki (JP); Satoshi Ibe, Yokohama (JP); Yoshinori Tagawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/948,606

(22) Filed: Jul. 23, 2013

(65) Prior Publication Data

US 2014/0028757 A1 Jan. 30, 2014

(30) Foreign Application Priority Data

Jul. 27, 2012 (JP) ..... 2012-167089

(51) Int. Cl.
*B41J 2/14* (2006.01)
*B41J 2/16* (2006.01)

(52) U.S. Cl.
CPC ..... *B41J 2/1433* (2013.01); *B41J 2/14024* (2013.01); *B41J 2/1603* (2013.01); *B41J 2/1628* (2013.01); *B41J 2/1629* (2013.01); *B41J 2/1631* (2013.01); *B41J 2/1632* (2013.01); *B41J 2/1639* (2013.01); *B41J 2202/11* (2013.01)
USPC ..... 347/47; 347/20

(58) Field of Classification Search
CPC ..... B41J 2/1433; B41J 2/14016; B41J 2/135; B41J 2/14; B41J 2/14145; B41J 2/1621
See application file for complete search history.

(56) References Cited

U.S. PATENT DOCUMENTS 7,267,431 B2 * 9/2007 Anderson et al. ..... 347/65

FOREIGN PATENT DOCUMENTS

JP 11-78056 A 3/1999

* cited by examiner

*Primary Examiner* — Juanita D Jackson
(74) *Attorney, Agent, or Firm* — Canon USA Inc IP Division

(57) ABSTRACT

A liquid ejection head includes a silicon substrate and an orifice plate disposed on or above the silicon substrate. The silicon substrate has a concave portion formed therein, and the orifice plate is disposed in the concave portion.

20 Claims, 9 Drawing Sheets

LIQUID EJECTION HEAD HAVING PROTECTED ORIFICE PLATE AND METHOD FOR MANUFACTURING LIQUID EJECTION HEAD

BACKGROUND OF THE INVENTION

1. Field of the Invention

The present disclosure relates to a liquid ejection head and a method for manufacturing a liquid ejection head.

2. Description of the Related Art

A liquid ejecting apparatus ejects droplets of liquid from a liquid ejection head and applies the droplets onto a printing medium. Thus, the liquid ejecting apparatus records an image on the printing medium. A liquid ejection head used for existing liquid ejecting apparatuses is illustrated in FIG. 9A.

As illustrated in FIG. 9A, the liquid ejection head includes a substrate 1 and an orifice plate 2 disposed on the substrate 1. In some cases, for example, an interconnecting wire and an insulation layer (neither are illustrated) are formed on a front surface of the substrate 1. Since the interconnecting wire and an insulation layer are very thin, the surface of the substrate 1 is substantially flat and smooth. The orifice plate 2 has an ejection port 3 formed therein. Liquid droplets are ejected from the ejection port 3 due to pressure generated by an energy generating device 4.

In recent years, a liquid ejecting apparatus has been expected to print a high-accuracy image. Accordingly, the ejected droplet of liquid is required to accurately land on the printing medium at a desired position. Thus, a distance d1 between the orifice surface 5 of the orifice plate (an open face having an opening of the ejection port) and a printing medium 6 is decreased so that the liquid droplet landing accuracy is increased.

However, when the distance between the orifice surface of the orifice plate and the printing medium is decreased and if the printing medium deforms, the printing medium is brought into contact with the orifice surface and, therefore, the orifice plate is damaged. Such a case is described below with reference to FIG. 9B. In this case, the printing medium is a sheet of paper. If a sheet of paper is jammed, the shape of the sheet changes. Even when the shape of the sheet of paper changes, the sheet is sometimes continuously conveyed. At that time, as illustrated in FIG. 9B, the sheet of paper is brought into contact with the orifice surface, and the orifice plate may be damaged. Such a problem easily occurs if, in particular, the orifice surface of the orifice plate is close to the printing medium. However, even when the orifice surface of the orifice plate is away from the printing medium by some small distance, such a problem may occur depending on the level of deformation of the printing medium. In addition, in order to produce the liquid ejection head in high accuracy, it is effective that the orifice plate is made of a resin or an inorganic film. However, the hardness of the orifice plate made of a resin or an inorganic film is not so high. Accordingly, if the orifice plate is brought into contact with a sharp sheet of paper, the orifice plate is easily damaged.

Furthermore, as illustrated in FIG. 9C, if the end face of the orifice plate is brought into contact with the printing medium, the entire orifice plate may be peeled off from the substrate.

To solve such a problem, Japanese Patent Laid-Open No. 11-78056 describes a technique in which the orifice surface of the orifice plate is covered by a protective member so that the orifice surface is protected from, for example, a printing medium.

SUMMARY OF THE INVENTION

According to an embodiment of the present disclosure, a liquid ejection head includes a silicon substrate and an orifice plate disposed on or above the silicon substrate. The silicon substrate has a concave portion formed therein, and the orifice plate is disposed in the concave portion.

Further features of the present invention will become apparent from the following description of exemplary embodiments with reference to the attached drawings.

DESCRIPTION OF THE EMBODIMENTS

Figure 1:
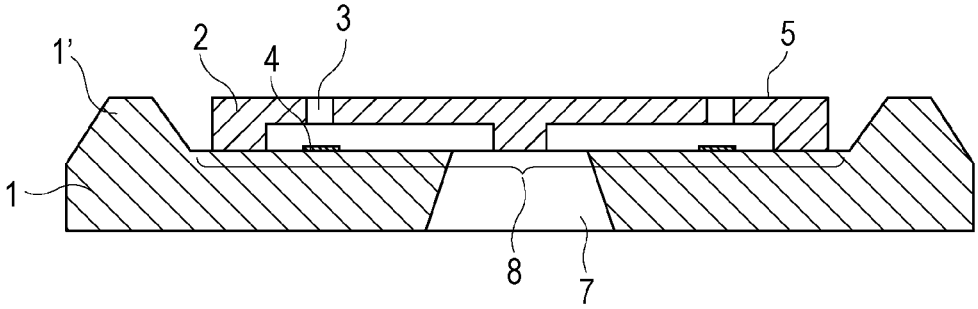
FIG. 1 illustrates an example of a liquid ejection head.

In the configuration described in Japanese Patent Laid-Open No. 11-78056, a protective member is additionally provided on the orifice surface. Accordingly, the number of parts increases. In addition, in order to form the ejection ports of the orifice plate in high array density, maintaining registration of the ejection port with respect to the protective member is difficult. That is, it is difficult to produce a high-accuracy liquid ejection head by using such a configuration.

As a technique other than the technique described in Japanese Patent Laid-Open No. 11-78056, the orifice plate can be formed of metal in order to increase the strength of the orifice surface. However, the orifice plate made of metal has a limitation in terms of the processing accuracy. Thus, it is difficult to produce a high-accuracy ejection port.

Therefore, the present disclosure provides a liquid ejection head having an orifice surface of the orifice plate that is negligibly damaged by a printing medium even when a protective member is not additionally provided. The present invention is described below.

Liquid Ejection Head

A liquid ejection head is described with reference to FIG. 1. The liquid ejection head includes a substrate 1 and an orifice plate 2 disposed on or above the substrate 1. The substrate 1 has an energy generating device 4 on the front surface thereof. The energy generating device 4 applies pressure to liquid supplied from a supply port 7 formed in the substrate 1 and ejects a droplet of the liquid from an ejection port 3. The energy generating device 4 may be a device that generates thermal energy or a piezoelectric transducer. In addition, the energy generating device 4 may be disposed on the substrate so as to be in contact with the surface of the substrate. Alternatively, the energy generating device 4 may be disposed on the surface of the substrate with a thin film therebetween. Still alternatively, the energy generating device 4 may be disposed above the substrate with a space therebetween. In existing liquid ejection heads, the surface of the substrate 1 is substantially flat and smooth for, for example, a manufacturing reason. However, the liquid ejection head according to the present invention has a concave portion 8 formed in the substrate 1. In addition, the orifice plate 2 is disposed in the concave portion 8.

Figure 2A:
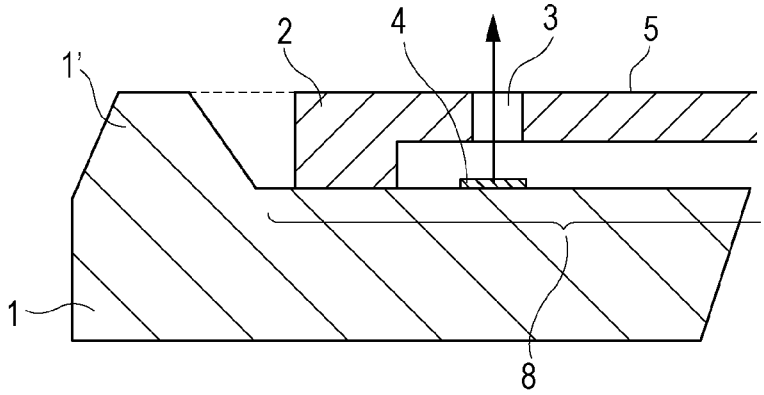
FIGS. 2A to 2C illustrate an example of a liquid ejection head.

FIG. 2A is an enlarged view of an end portion of the concave portion 8 illustrated in FIG. 1. The concave portion 8 is formed so as to be surrounded by a side wall 1', which is part of the substrate 1. Since the liquid ejection head according to the present exemplary embodiment has such a structure, a printing medium is not brought into contact with the orifice plate. Thus, the orifice surface is negligibly damaged.

Figure 3:
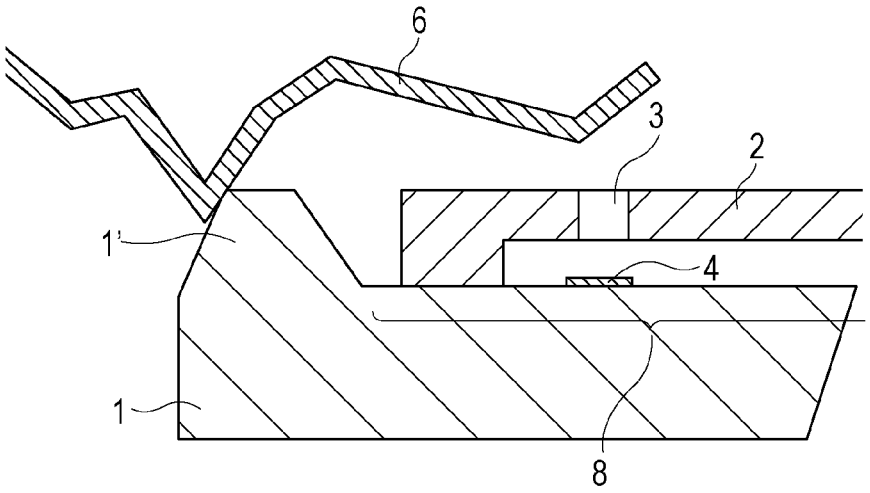
FIG. 3 illustrates an example in which a sheet of paper that is brought into contact with the liquid ejection head.

FIG. 3 illustrates a sheet of paper deformed by jamming in the case of the printing medium being a sheet of paper. According to the present exemplary embodiment, the liquid ejection head has the orifice plate 2 disposed in a concave portion 8 of the substrate 1. Accordingly, even when the printing medium 6 that deforms is conveyed, the side wall 1' tends to be brought into contact with the printing medium 6 before the orifice plate 2 is brought into contact with the printing medium 6. That is, the orifice surface of the orifice plate 2 can be protected by the presence of the side wall 1'.

The side wall 1' is formed from the substrate 1. The substrate 1 is made of silicon (i.e., a silicon substrate). The orifice plate 2 is made of a resin or an inorganic material. In such a configuration, the hardness of the substrate 1 is higher than that of the orifice plate 2. If the hardness of the substrate 1 is higher than that of the orifice plate 2, the printing medium that is in contact with the side wall 1' is negligibly brought into contact with the orifice plate 2. Accordingly, such a configuration is preferable. In addition, even when the orifice plate 2 is brought into contact with the printing medium 6 before the side wall 1' is brought into contact with the printing medium 6 and, thus, the printing medium 6 attempts to cut into the orifice plate 2, the printing medium 6 is brought into contact with the side wall 1' and does not further cut into the orifice plate 2. Accordingly, significant damage of the orifice plate 2 can be prevented. As described above, according to the present exemplary embodiment, the orifice plate 2 can be protected by using an existing substrate without additionally providing a protective member. In this manner, a significant benefit that the orifice surface 5 is negligibly damaged can be provided.

Figure 2B:
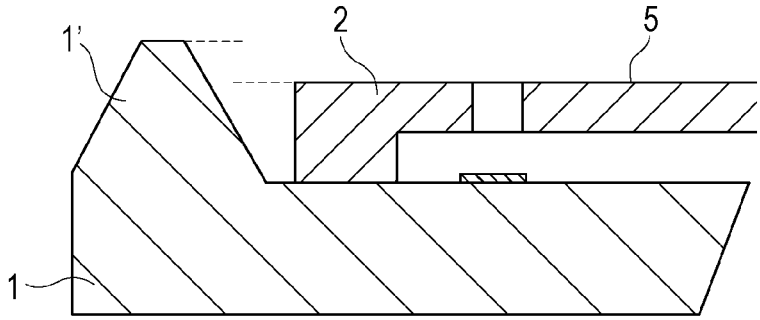

According to the present exemplary embodiment, let a direction in which the liquid ejection head illustrated in FIG. 2A ejects a droplet of liquid (indicated by an arrow) be an upward direction. Then, it is desirable that the upper surface of a side wall 1' of the substrate 1 that forms the concave portion 8 be located at the same height or higher than the orifice surface 5 of the orifice plate 2. FIG. 2A illustrates the upper surface of the side wall 1' located at the same level as the orifice surface 5 of the orifice plate 2. FIG. 2B illustrates the upper surface of the side wall 1' located at a position higher than that of the orifice surface 5 of the orifice plate 2. If the upper surface of the side wall 1' of the substrate 1 that form the concave portion 8 is located at the same height or higher than the orifice surface 5 of the orifice plate 2, contact of the printing medium that deforms with the orifice plate 2 can be excellently prevented. In order to prevent contact of the printing medium with the orifice plate 2 as earliest as possible, it is desirable that as illustrated in FIG. 2B, the upper surface of the side wall 1' be located at a position higher than the orifice surface 5 of the orifice plate 2.

Figure 2C:
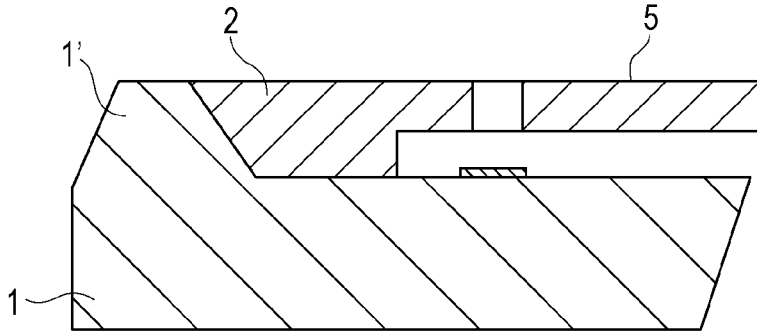

Note that in order to increase the strength of the side wall 1', it is desirable that as illustrated in FIG. 2C, the orifice plate 2 be in contact with the side wall 1'. In such a configuration, since the side wall 1' is supported by the orifice plate 2, the strength of the side wall 1' can be increased. If the side wall 1' is in contact with the orifice plate 2 in this manner, it is desirable that the upper surface of the side wall 1' and the orifice surface 5 of the orifice plate 2 be aligned in a direction perpendicular to the surface of the substrate 1. In this manner, the side wall 1' that is protruding is not broken by the printing medium.

In summary, the following positional relationship between the upper surface of the side wall and the orifice surface of the orifice plate in the direction perpendicular to the surface of the substrate is desirable. That is, if the side wall is not in contact with the orifice plate, it is desirable that the upper surface of the side wall be higher than the orifice surface of the orifice plate. At that time, it is desirable that the difference in height between the upper surface of the side wall and the orifice surface of the orifice plate be greater than or equal to 2 μm and lower than or equal to 30 μm. However, if the side wall is in contact with the orifice plate, it is desirable that the upper surface of the side wall and the orifice surface of the orifice plate are aligned. At that time, it is desirable that the difference in height between the upper surface of the side wall and the orifice surface of the orifice plate be less than or equal to 10 μm.

Note that the orifice plate is a member that has an ejection port formed therein and that is disposed on or above the substrate. According to the present exemplary embodiment, a member that is disposed on the substrate and that is made of a material that is the same as the material of the member having the ejection port formed therein is also referred to as an "orifice plate".

Figure 4A:
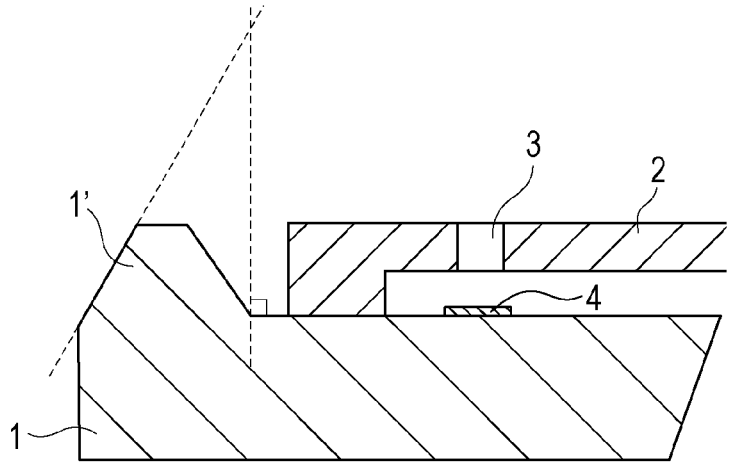
FIGS. 4A and 4B illustrate an example of a liquid ejection head.

Any configuration of the side wall 1' that has a concave portion formed in the substrate can be employed. However, in order to effectively reduce the force received from the printing medium that deforms, it is desirable that as illustrated in FIG. 4A, a surface of the side wall 1' opposite to the surface adjacent to the orifice plate be inclined away from the direction perpendicular to the surface of the substrate 1. In particular, it is desirable that as illustrated in FIG. 4A, the surface slope upward toward the orifice plate 2. By excellently reducing a force received from the printing medium that deforms in this manner, the side wall 1' is not broken by the printing medium that is in contact with the side wall 1'. In addition, it is desirable that the surface of the side wall 1' adjacent to the orifice plate 2 also slope from the direction perpendicular to the surface of the substrate. That is, it is desirable that the width of the side wall 1' decreases upward, that is, the side wall 1' taper.

Figure 4B:
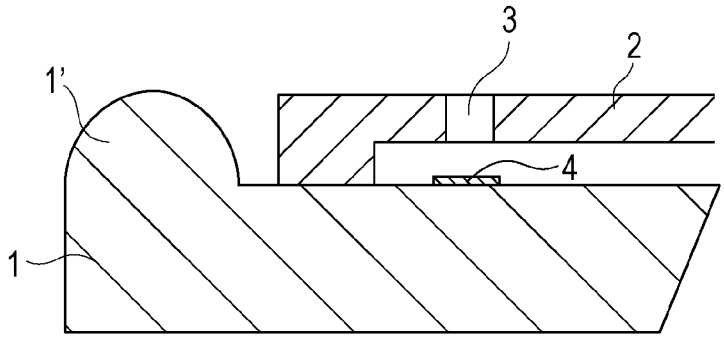

In addition, it is desirable that as illustrated in FIG. 4B, the surface of the side wall 1' opposite to the surface adjacent to the orifice plate 2 have a round shape. Even in such a case, the force received from the printing medium that deforms can be excellently reduced.

It is desirable that the width of the upper surface of the side wall 1' be greater than or equal to 50 μm and less than or equal to 100 μm. If the width of the upper surface is less than 50 μm, the strength of the side wall 1' is insufficient and, therefore, the side wall 1' is easily damaged by a printing medium. In contrast, if the width of the upper surface is greater than 100 μm, the width of the substrate 1 is too large and, therefore, it is difficult to acquire a large number of substrates from a single wafer. Note that if the surface of the side wall 1' has a round shape, the upper surface of the side wall 1' may be parallel to the surface of the substrate 1 at only a single point. However, in such a case, since a force received from the printing medium that deforms can be excellently reduced, there is no problem even when the width of the upper surface of the side wall 1' is less than 50 μm.

The substrate forms the side wall 1' and protects the orifice plate 2. Accordingly, it is desirable that the hardness of the substrate 1 be higher than that of the orifice plate 2. For reasons such as hardness and manufacturing, the substrate 1 is formed from a silicon substrate.

It is desirable that the orifice plate be made of a resin or an inorganic film, since the ejection port, for example, can be accurately produced by using a resin or an inorganic film. When the orifice plate is made of a resin, it is desirable that the resin be a photosensitive resin, since negative photosensitive resin allows more accurate formation of an ejection port. It is desirable that the photosensitive resin be negative photosensitive resin. Examples of the negative photosensitive resin include an epoxy resin, a vinyl ether-based resin, and an oxetane-based resin. In particular, an epoxy resin is preferable. If the orifice plate 2 is made of an inorganic film, SiC, SiN, or SiCN, for example, can be employed.

Figure 5:
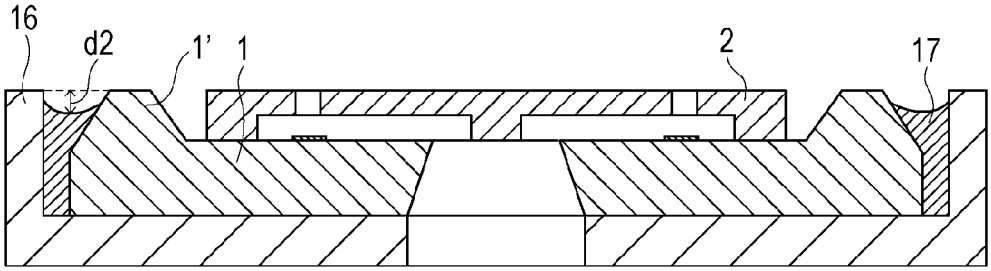
FIG. 5 illustrates an example of a liquid ejection head.

As illustrated in FIG. 5, it is desirable that the liquid ejection head include a support member 16 that supports the substrate 1. The support member 16 is made of, for example, alumina. It is desirable that a gap formed between the substrate 1 and the support member 16 in a direction parallel to the surface of the substrate 1 be sealed by a sealing member 17. At that time, it is desirable that a difference d2 in height between the upper surface of the sealing member 17 and the upper surface of the side wall 1' be less than or equal to 10 μm. In this manner, the sealing member 17 can support the side wall 1' and, therefore, the strength of the side wall 1' can be increased. At that time, it is desirable that the upper surface of the sealing member 17 be lower than the upper surface of the side wall 1' in the direction perpendicular to a surface of the substrate 1. If the upper surface of the sealing member 17 is at the same height or higher than the orifice surface of the side wall 1', the sealing member 17 is brought into contact with the printing medium that deforms before the side wall 1' is brought into contact with the printing medium. Thus, the sealing member 17 is scraped by the printing medium, and the scraped debris of the sealing member 17 is located in the vicinity of the ejection port. Accordingly, ejection of droplets of the liquid may be interfered.

Method for Manufacturing Liquid Ejection Head

First Exemplary Embodiment

A method for manufacturing the liquid ejection head according to the present exemplary embodiment is described next with reference to FIGS. 6A to 6I.

Figure 6A:
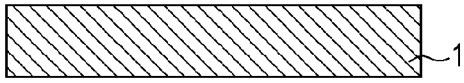
FIGS. 6A to 6I illustrate an example of a method for manufacturing a liquid ejection head.

As illustrated in FIG. 6A, the substrate 1 is prepared first. At that time, a silicon substrate is used as the substrate 1.

Figure 6B:
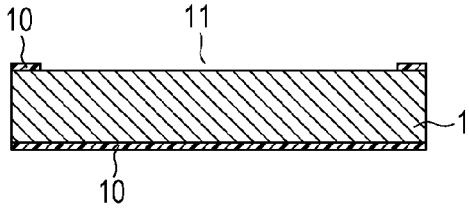

Subsequently, as illustrated in FIG. 6B, a mask 10 is disposed on the front surface of the substrate 1. Any mask that serves as an etching mask when forming the concave portion 8 can be used as the mask 10. For example, when the concave portion 8 is formed by wet etching using etchant, cyclized rubber is used. In contrast, when the concave portion 8 is formed by reactive dry etching using, for example, fluorinated gas or chlorine gas, a photoresist, which is widely used in a semiconductor process, is used.

The mask 10 on the front surface forms an opening 11 corresponding to the concave portion 8 to be formed. When the substrate 1 is dipped in the etchant for etching, it is desirable that the mask 10 be also disposed on the back surface of the substrate 1. In such a case, it is desirable that the mask 10 on the back surface cover the entirety of the back surface. The mask 10 on the back surface may be formed by covering the back surface of the substrate 1 using the cyclized rubber. In such a case, like the back surface, it is desirable that a side surface of the substrate 1 be also covered.

Figure 6C:
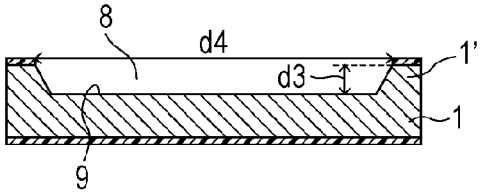

Subsequently, as illustrated in FIG. 6C, the substrate 1 is etched, and the concave portion 8 is formed in the front surface of the substrate 1. According to the present exemplary embodiment, as an example, the substrate 1 is etched by anisotropic etching using tetramethylammonium hydroxide (TMAH) solution. It is desirable that the depth of the concave portion 8 to be formed be greater than or equal to 25 μm and less than or equal to 100 μm. If the depth of the concave portion 8 is less than 25 μm, the orifice plate 2 is often not sufficiently protected even when the orifice plate is disposed in the concave portion 8. In contrast, if the depth of the concave portion 8 is greater than 100 μm, it is difficult to form an interconnecting wire, a variety of layers, and the orifice plate 2 in the concave portion 8. Note that in FIG. 6C, the depth of the concave portion 8 is indicated by a reference symbol "d3", that is, the depth is equal to a length from a bottom 9 of the concave portion 8 to the height of the upper surface of the side wall 1' in the direction perpendicular to the surface of the substrate 1. In addition, it is desirable that the depth d3 of the concave portion 8 and an upper opening width d4 of the concave portion 8 be set so that d4/d3 is greater than or equal to 20/1 and less than or equal to 600/1. By setting d4/d3 to a value in this range, the orifice plate 2 is sufficiently protected and, in addition, the interconnecting wire and the orifice plate 2 can be excellently formed.

In order to stabilize the shape of the concave portion 8 and facilitate formation of the interconnecting wire and the orifice plate 2 in the concave portion 8, it is desirable that the substrate 1 have a crystal plane orientation of (100). If the substrate 1 has a crystal plane orientation of (100), the plane orientation of each of the front and back surfaces of the substrate 1 illustrated in FIGS. 6A to 6I is (100). In addition, the plane orientation of the bottom 9 of the concave portion 8 is (100). If a surface has a plane orientation of (100), an interconnecting wire and the orifice plate 2 can be easily formed on the surface. Furthermore, through anisotropic etching, the slope surface of the concave portion 8, that is, a side surface of the side wall 1' adjacent to the orifice plate 2 can have a plane orientation of (111). The (111) plane is inclined 54.7 degrees with respect to the (100) surface and can be stably formed.

Figure 6D:
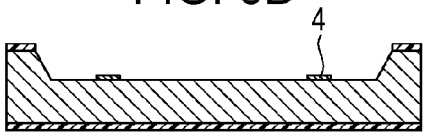

Subsequently, as illustrated in FIG. 6D, the energy generating device 4 is formed in the concave portion 8 formed in the substrate 1. In addition, for example, an interconnecting wire of the energy generating device 4, an insulating layer, and an adhesion enhancing layer between the substrate 1 and the orifice plate 2 are formed as needed.

Subsequently, the orifice plate 2 is formed in the concave portion 8. The orifice plate 2 can be formed by stacking dry films or covering a mold material of a liquid flow passage with a coating layer. In this example, the orifice plate 2 is formed by covering a mold material of a liquid flow passage with a coating layer.

Figure 6E:
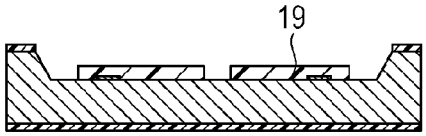

A mold material of a liquid flow passage is formed in the concave portion 8 first. For example, the mold material is formed by applying coating liquid to the concave portion 8, drying the coating liquid, and patterning the dried coating liquid. It is desirable that the coating liquid be applied so that the concave portion 8 is filled with the coating liquid until the coating liquid is brought into contact with the side wall 1'. Through patterning, a mold material 19 is formed in the concave portion 8, as illustrated in FIG. 6E. The coating liquid that forms the mold material 19 is removed after patterning of the mold material. Accordingly, it is desirable that the coating liquid contain a positive photosensitive resin. That is, it is desirable that the mold material 19 contain a positive photosensitive resin. Examples of the positive photosensitive resin include polymethyl isopropenyl ketone, polymethylmethacrylate, and polymethylglutarimide. Note that any type of the mold material 19 that can be removed afterward can be used. For example, the mold material 19 can be formed of a metal, such as aluminum.

Figure 6F:
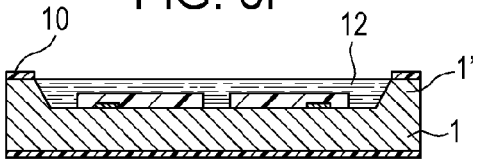
Figure 6G:
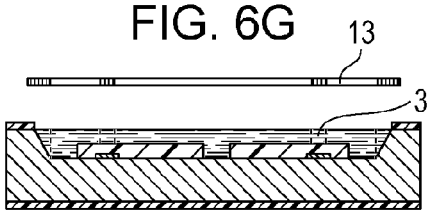

Subsequently, as illustrated in FIG. 6F, coating liquid 12 containing a resin is applied to the concave portion 8. The coating liquid 12 covers the mold material 19 and, thereafter, is cured. Thus, the coating liquid 12 is turned into a coating layer of the mold material 19. It is desirable that the coating liquid 12 be stored within the concave portion 8. In addition, it is desirable that the resin contained in the coating liquid 12 be a photosensitive resin. If a photosensitive resin is used, the layer formed using a mask 13 and the coating liquid 12 is subjected to pattern exposure, as illustrated in FIG. 6G, and is developed. Thus, the ejection port 3 can be easily formed. Alternatively, the mold material 19 may be covered by an inorganic film, such as SiC or SiCN, instead of the coating liquid 12. Thereafter, dry etching may be performed on the inorganic film to form the ejection port 3.

Figure 6H:
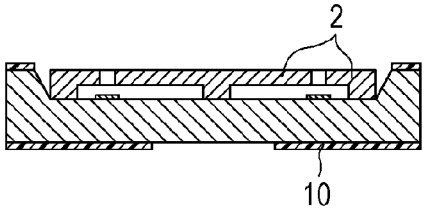

Subsequently, as illustrated in FIG. 6H, the mask 10 disposed on the back surface is partially removed, and an opening is formed in order to form a supply port. In addition, the mask 10 disposed on the front surface of the substrate 1 is removed. The mask 10 can be removed in a removing step corresponding to the material of the mask 10. For example, if the mask 10 is formed of a widely used positive type photoresist, the mask 10 can be removed by using corresponding developing solution after entire surface exposure. However, if the mask 10 is formed of a cyclized rubber based photoresist, the mask 10 can be removed by using, for example, xylene solvent. The mask 10 disposed on the front surface and the mask 10 disposed on the back surface can be removed at the same time. The timing at which the mask 10 is removed is not limited to the above-described timing. For example, the mask 10 may be removed at any one of the timings illustrated in FIGS. 6D to 6G.

Figure 6I:
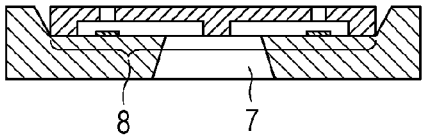

Subsequently, the substrate 1 is etched using the mask disposed on the back surface of the substrate 1. Thus, the supply port 7 is formed in the substrate 1. After the supply port 7 is formed, the mold material 19 is removed using, for example, solvent. In addition, the mask disposed on the back surface is removed as needed. Finally, the entirety of the liquid ejection head is heated. In this manner, the liquid ejection head illustrated in FIG. 6I is manufactured.

The liquid ejection head manufactured in this manner includes the substrate 1 having the concave portion 8 formed therein. The concave portion 8 has the orifice plate 2 disposed therein. Accordingly, the orifice surface of the orifice plate 2 is negligibly damaged even when a protective member is not additionally provided.

Second Exemplary Embodiment

Figure 7A:
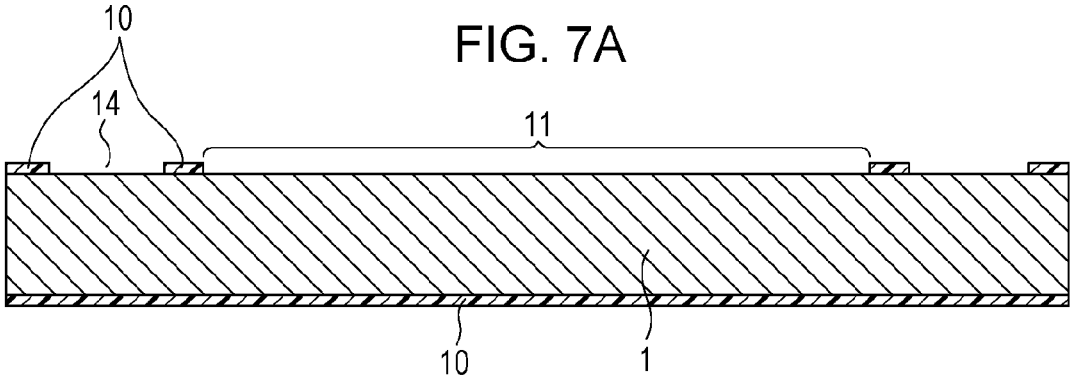
FIGS. 7A to 7D illustrate an example of a method for manufacturing a liquid ejection head.

Another method for manufacturing a liquid ejection head according to a second exemplary embodiment is described below with reference to FIGS. 7A to 7D. According to the present exemplary embodiment, the mask 10 disposed on the front surface of the substrate 1 is placed as illustrated in FIG. 7A. The mask 10 disposed on the front surface includes the opening 11 corresponding to the concave portion 8 to be formed and an opening 14 located on the outer side of the opening 11. Like the first exemplary embodiment, a mask 10 is disposed on the back surface of the substrate 1. The substrate 1 has a crystal plane orientation of (100). The plane orientations of each of the front and back surfaces of the substrate 1 is (100).

Figure 7B:
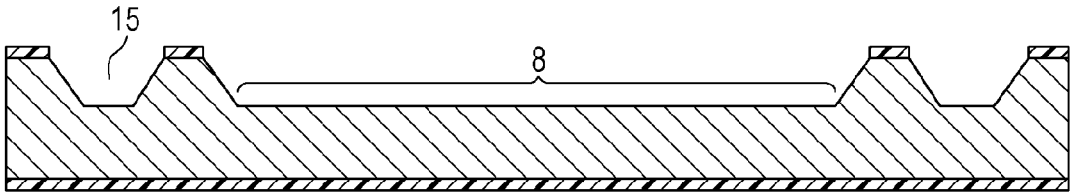
Figure 7C:
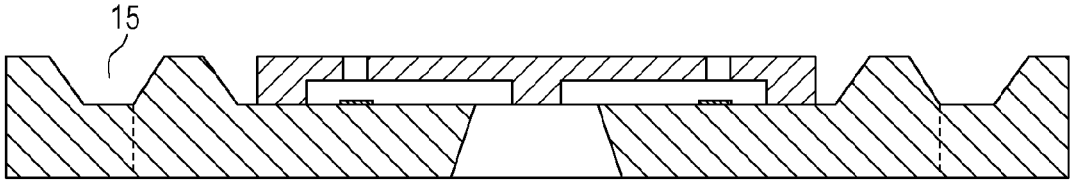

Subsequently, as illustrated in FIG. 7B, the substrate 1 is etched using the mask 10. Thus, the concave portion 8 and a concave portion 15 located on the outer side of the concave portion 8 are formed in the front surface of the substrate 1. Thereafter, like the first exemplary embodiment, as illustrated in FIG. 7C, the orifice plate 2 is disposed in the concave portion 8 of the substrate 1.

Figure 7D:
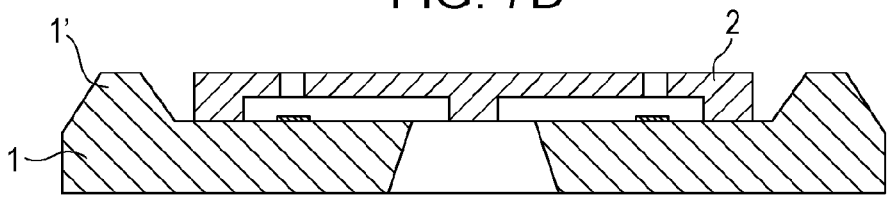

According to the present exemplary embodiment, the substrate 1 is cut using, for example, a dicing blade at the location of the concave portion 15, which differs from the location of the concave portion 8. In this manner, the liquid ejection head illustrated in FIG. 7D is manufactured. As illustrated in FIG. 7D, the liquid ejection head includes a side wall 1' having a surface opposite to the surface adjacent to an orifice plate 2. The surface is inclined in relation to the direction perpendicular to the surface of the substrate 1. In addition, the surface adjacent to an orifice plate 2 is also inclined in relation to the direction perpendicular to the surface of the substrate 1. Thus, the side wall 1' tapers. Since the liquid ejection head illustrated in FIG. 7D includes the side wall 1' having a surface opposite to the surface adjacent to the orifice plate 2 and, in addition, the surface is inclined in relation to the direction perpendicular to the surface of the substrate 1, an external force received by the side surface can be efficiently reduced and, therefore, cracking or damage of the side wall negligibly occurs. In addition, since the concave portion 15 is additionally formed and the substrate 1 is cut at the location of the concave portion 15, the substrate 1 can be easily cut.

Third Exemplary Embodiment

Figure 8A:
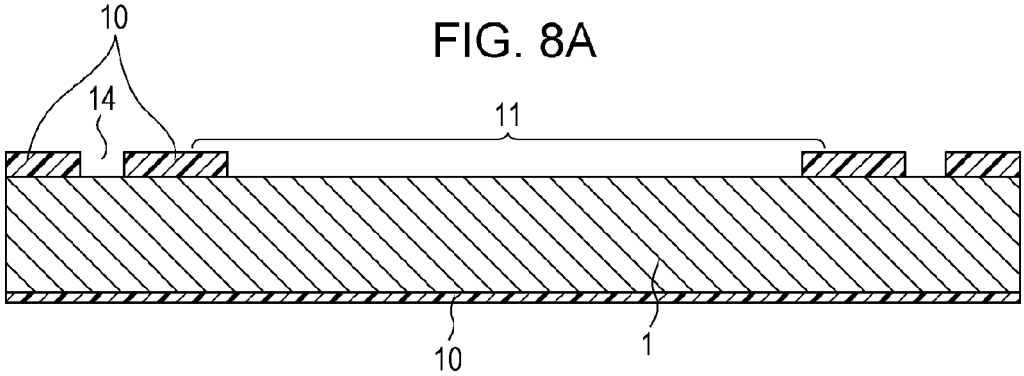
FIGS. 8A to 8D illustrate an example of a method for manufacturing a liquid ejection head.

Another method for manufacturing a liquid ejection head according to a third exemplary embodiment is described below with reference to FIGS. 8A to 8D. According to the present exemplary embodiment, a mask 10 disposed on the front surface of the substrate 1 is placed as illustrated in FIG. 8A. The material of the mask 10 is a resin having a softening point lower than or equal to 100° C. It is desirable that the resin be a photosensitive resin and, in particular, a positive photosensitive resin.

Figure 8B:
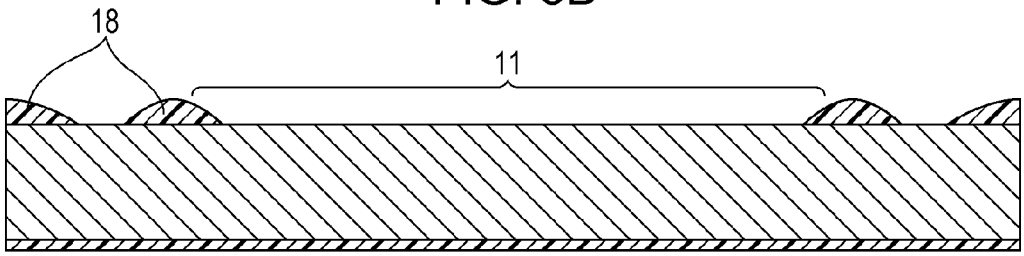

Subsequently, by heating the substrate 1, a reflow treatment is performed on the mask 10. If the mask 10 contains a resin having a softening point lower than or equal to 100° C., the side wall of the mask 10 has a round shape. As illustrated in FIG. 8B, a mask having a round shaped side wall is referred to as a "mask 18". The substrate 1 can be heated by using one of, for example, an ordinary oven, a bake oven, and infrared irradiation selected in accordance with the shape of the substrate 1 and the employed processes. At that time, the heating temperature and the heating time are appropriately controlled. In this manner, the mask 18 having a round shape is formed. It is desirable that the heating temperature be higher than or equal to 100° C. In addition, in order to prevent, for example, carbonization of the mask 18, it is desirable that the heating temperature be lower than or equal to 200° C.

Figure 8C:
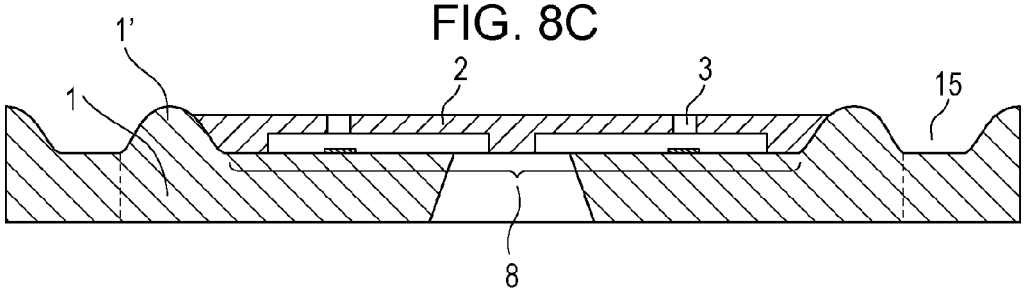

Subsequently, as illustrated in FIG. 8C, dry etching is performed using the mask 18 as an etching mask. In this manner, a side wall 1' is formed. A surface of the side wall 1' opposite to the surface adjacent to the orifice plate 2 has a round shape. At that time, any etching gas that provides the etching selection ratio of the material of the substrate 1 to the mask 18 can be employed. For example, dry etching may be performed by using a sputtering method with inactive gas, such as argon gas, nitrogen gas, helium gas, or xenon gas.

Alternatively, reactive dry etching may be performed using, for example, fluorine-based gas, chlorine gas, bromine gas, or sulfidizing gas.

When using a sputtering method, the etching selection ratio of the substrate 1 to the mask 18 is 1:1, in general. The shape and the height of the mask 18 is directly traced on the substrate 1, and the side wall 1' having the same shape as the mask 18 is formed. In contrast, when reactive dry etching is employed and if the etching selection ratio of the substrate 1 to the mask 18 is varied, the height of the side wall 1' can be changed in accordance with the etching selection ratio. For example, in reactive dry etching using fluorine-based gas, the etching selection ratio of a widely used a resin resist (a mask) to silicon is in the range from 1:2 to 1:5. Thus, the side wall 1' can have a shape obtained by expanding the shape of the mask 18 by a factor of 2 to 5 in the direction perpendicular to the surface of the substrate 1.

Thereafter, the mask 18 used as an etching mask is removed. If the mask 18 is formed of a positive photosensitive resin, the mask 18 can be easily removed using an exposure process and a development process. In contrast, if the mask 18 is formed of a negative photosensitive resin, the mask 18 can be removed by continuously performing etching until the mask 18 is completely removed in the etching step. Thus, the need for a step of removing the mask 18 can be eliminated.

Figure 8D:
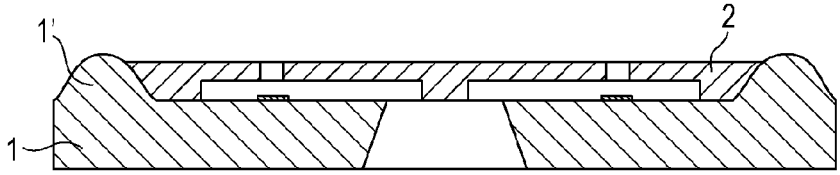
Figure 9A:
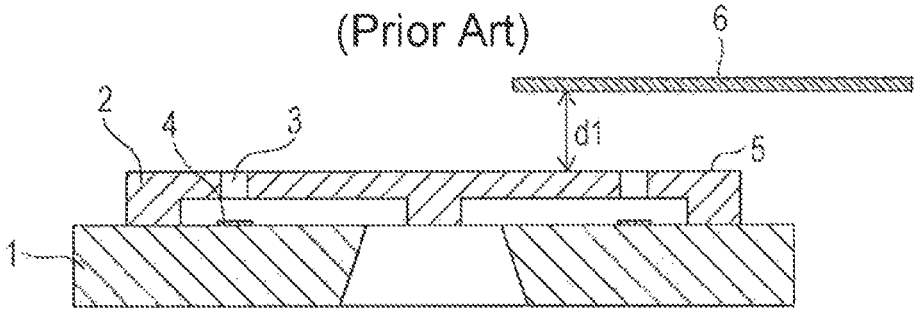
FIG. 9A (Prior Art)
FIGS. 9A to 9C illustrate an example in which a sheet of paper that is brought into contact with a liquid ejection head.
Figure 9B:
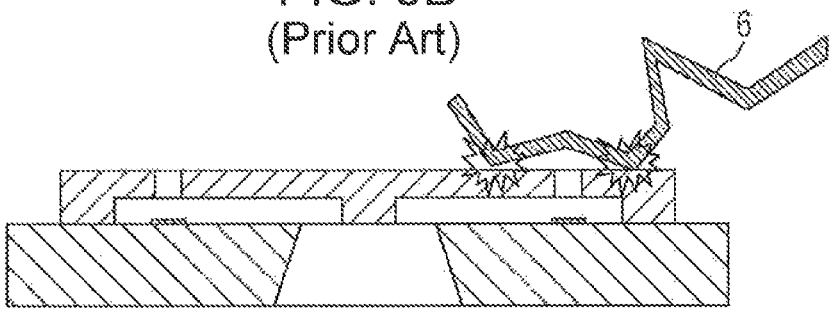
FIG. 9B (Prior Art)
Figure 9C:
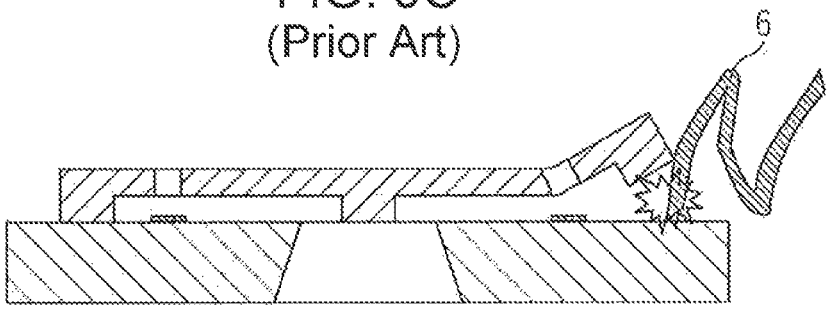
FIG. 9C (Prior Art)

Subsequently, as in the first exemplary embodiment, as illustrated in FIG. 8C, a liquid ejection head including the substrate 1 having the concave portion 8 formed therein and the orifice plate 2 disposed in the concave portion 8 is manufactured. Finally, the substrate 1 is cut using, for example, a dicing blade at the location of the concave portion 15 provided in addition to the concave portion 8. In this manner, the liquid ejection head illustrated in FIG. 8D is manufactured. As illustrated in FIG. 8D, the surface of the side wall 1' opposite to the surface adjacent to the orifice plate has a round shape. Thus, an external force received by the side surface can be efficiently reduced and, therefore, cracking or damage of the side wall negligibly occurs.

According to the exemplary embodiments, a liquid ejection head having the orifice surface of an orifice plate that is negligibly damaged by, for example, a printing medium can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-167089 filed Jul. 27, 2012, which is hereby incorporated by reference herein in its entirety.

What is claimed is:

1. A liquid ejection head comprising:

a silicon substrate; and an orifice plate disposed on or above the silicon substrate, wherein the silicon substrate has a concave portion formed therein, and the orifice plate is disposed within the concave portion, and a hardness of the silicon substrate is greater than that of the orifice plate.

2. The liquid ejection head according to claim 1, wherein when a direction that the liquid ejection head ejects a droplet of liquid is an upward direction, an upper surface of a side wall of the silicon substrate that forms the concave portion is located at a same or higher level than an orifice surface of the orifice plate.

3. The liquid ejection head according to claim 2, further comprising:

a support member configured to support the silicon substrate, wherein a gap formed between the support member and the silicon substrate is sealed by a sealing member, and an upper surface of the sealing member is lower than an upper surface of the side wall of the silicon substrate that forms the concave portion in a direction perpendicular to a surface of the silicon substrate.

4. The liquid ejection head according to claim 1, wherein the orifice plate is formed of one of a resin or an inorganic film.

5. The liquid ejection head according to claim 1, wherein when d3 denotes a depth of the concave portion in a direction perpendicular to a surface of the substrate and d4 denotes a width of an upper opening of the concave portion, wherein a ratio d4/d3 is greater than or equal to 20/1 and less than or equal to 600/1.

6. The liquid ejection head according to claim 1, wherein a surface of a side wall of the silicon substrate that forms the concave portion opposite a surface of a side wall adjacent to the orifice plate is inclined in relation to a direction perpendicular to a surface of the silicon substrate.

7. The liquid ejection head according to claim 1, wherein a surface of a side wall of the silicon substrate that forms the concave portion opposite a surface of a side wall adjacent to the orifice plate has a round shape.

8. The liquid ejection head according to claim 1, wherein a side wall of the silicon substrate that forms the concave portion contacts the orifice plate.

9. The liquid ejection head according to claim 8, wherein a difference between a position of an upper surface of a side wall of the silicon substrate that forms the concave portion and a position of the orifice surface of the orifice plate in a direction perpendicular to a surface of the silicon substrate is less than or equal to 10 μm.

10. The liquid ejection head according to claim 1, wherein a side wall of the silicon substrate that forms the concave portion is not in contact with the orifice plate.

11. The liquid ejection head according to claim 10, wherein a difference between a position of an upper surface of the side wall of the silicon substrate that forms the concave portion and a position of the orifice surface of the orifice plate in a direction perpendicular to a surface of the silicon substrate is greater than or equal to 2 μm and less than or equal to 30 μm.

12. A liquid ejection head comprising:

a silicon substrate;

an orifice plate disposed on or above the silicon substrate; and a support member configured to support the silicon substrate, wherein a gap formed between the support member and the silicon substrate is sealed by a sealing member, and an upper surface of the sealing member is lower than an upper surface of the side wall of the silicon substrate that forms the concave portion in a direction perpendicular to a surface of the silicon substrate.

13. The liquid ejection head according to claim 12, wherein a hardness of the silicon substrate is greater than that of the orifice plate.

14. A method for manufacturing a liquid ejection head, the liquid ejection head including a silicon substrate and an orifice plate disposed on the silicon substrate, the method comprising:

preparing the silicon substrate having a mask, the mask having an opening formed therein;

forming a concave portion in the silicon substrate through the opening of the mask by etching the silicon substrate; and placing the orifice plate in the concave portion.

15. The method according to claim 14, wherein the silicon substrate has a crystal plane orientation of (100), and wherein by performing anisotropic etching on the silicon substrate, the concave portion is formed in the silicon substrate through the opening of the mask.

16. The method according to claim 15, wherein the mask has an opening corresponding to the concave portion and another opening located on an outer side of the opening corresponding to the concave portion, wherein by performing anisotropic etching on the silicon substrate, the concave portion is formed in the silicon substrate through the opening corresponding to the concave portion, and wherein by forming another concave portion through the other opening, a side wall of the silicon substrate that forms the concave portion is formed so that a surface of the side wall of the silicon substrate that forms the concave portion opposite a surface of the side wall adjacent to the orifice plate is inclined in relation to a direction perpendicular to a surface of the silicon substrate.

17. The method according to claim 16, wherein the silicon substrate is cut at a location of the other concave portion.

18. The method according to claim 14, wherein the mask contains a photosensitive resin having a softening point less than or equal to 100° C., and wherein by heating the silicon substrate to perform a reflow treatment, a side wall of the mask is made to have a round shape.

19. The method according to claim 18, wherein by etching the silicon substrate using a sputtering technique, a surface of the side wall of the silicon substrate that forms the concave portion opposite a surface of the side wall adjacent to the orifice plate is made to have a round shape.

20. The method according to claim 18, wherein by performing reactive dry etching on the silicon substrate, a surface of the side wall of the silicon substrate that forms the concave portion opposite a surface of the side wall adjacent to the orifice plate is made to have a round shape.

* * * * *